US012723579B2

(12) United States Patent
Dorin et al.

(10) Patent No.: US 12,723,579 B2
(45) Date of Patent: Sep. 1, 2026

(54) DRY-SUMP RECIPROCATING PISTON COMPRESSOR WITH LUBRICANT CIRCUIT

(71) Applicant: OFFICINE MARIO DORIN S.P.A., Fiesole (IT)

(72) Inventors: Mario Dorin, Pontassieve (IT); Mauro Dallai, Florence (IT)

(73) Assignee: OFFICINE MARIO DORIN S.P.A., Fiesole (IT)

( * ) Notice: Subject to any disclaimer, the term of this patent is extended or adjusted under 35 U.S.C. 154(b) by 0 days.

(21) Appl. No.: 19/119,358

(22) PCT Filed: May 21, 2024

(86) PCT No.: PCT/IT2024/050099

§ 371 (c)(1),
(2) Date: Apr. 8, 2025

(87) PCT Pub. No.: WO2025/022471

PCT Pub. Date: Jan. 30, 2025

(65) Prior Publication Data

US 2026/0132776 A1 May 14, 2026

(30) Foreign Application Priority Data

Jul. 27, 2023 (IT) ..... 102023000015909

(51) Int. Cl.

| | |
|---|---|
| ***F04B 39/02*** | (2006.01) |
| ***F04B 19/22*** | (2006.01) |
| ***F04B 39/00*** | (2006.01) |

(52) U.S. Cl.

CPC ..... *F04B 39/02* (2013.01); *F04B 19/22* (2013.01); *F04B 39/0094* (2013.01)

(58) Field of Classification Search

CPC ..... F04B 39/02; F04B 19/22; F04B 39/0094; F04B 39/0207; F04B 39/0246; F04B 39/0261; F04B 39/128; F04B 39/0238; F04B 53/18; F25B 31/002; F25B 31/004

USPC ..... 417/313, 372, 902; 62/84, 192, 470; 184/6.13

See application file for complete search history.

(56) References Cited

U.S. PATENT DOCUMENTS

| | | | | | |
|---|---|---|---|---|---|
| 1,738,560 | A * | 12/1929 | Brewer | F01M 1/06 | 123/54.2 |
| 1,893,040 | A * | 1/1933 | Schmidt | F16N 7/40 | 184/6.13 |
| 2,294,552 | A * | 9/1942 | Gygax | F25B 31/002 | 62/196.2 |
| 2,513,547 | A * | 7/1950 | Buell | F16C 3/14 | 417/571 |
| 2,646,212 | A * | 7/1953 | Kellie | F04B 39/0207 | 417/228 |

(Continued)

FOREIGN PATENT DOCUMENTS

| | | | |
|---|---|---|---|
| EP | 4187090 | A1 | 5/2023 |
| WO | 2014130530 | A1 | 8/2014 |
| WO | 2020115694 | A1 | 6/2020 |

*Primary Examiner* — Mark A Laurenzi
*Assistant Examiner* — Benjamin Doyle
(74) *Attorney, Agent, or Firm* — Maschoff Brennan

(57) ABSTRACT

An extremely compact dry-sump reciprocating compressor comprising an underlying external reservoir in which lubricant is collected by gravity and a positive displacement pump that draws lubricant from said reservoir to feed it into a distribution circuit.

19 Claims, 5 Drawing Sheets

(56) References Cited

U.S. PATENT DOCUMENTS 2,956,730 A * 10/1960 Hamilton ..... F16N 7/32 417/372
3,163,999 A * 1/1965 Ditzler ..... F25B 31/002 415/206
3,204,865 A * 9/1965 Neubauer ..... F04B 39/04 417/248
3,236,062 A * 2/1966 Roach ..... F25B 31/00 62/505
3,379,033 A * 4/1968 Grant ..... F25B 31/006 62/84
3,528,394 A * 9/1970 Cummins ..... F02B 75/28 123/189
3,721,108 A * 3/1973 Kocher ..... F25B 31/006 62/505
4,505,650 A 3/1985 Hannett
4,530,215 A * 7/1985 Kramer ..... F25B 31/002 62/468
4,531,379 A * 7/1985 Diefenthaler, Jr. .. B60H 1/3226 60/714
4,755,110 A * 7/1988 Bauer ..... F04B 39/0261 417/372
4,890,461 A * 1/1990 Zimmern ..... F04C 18/52 62/505
5,154,585 A * 10/1992 Spencer ..... F04B 39/0207 417/364
5,382,141 A * 1/1995 Stinessen ..... F04D 25/0686 166/105.5
5,511,523 A * 4/1996 Masuda ..... F01M 9/108 123/198 C
5,591,011 A * 1/1997 Mantooth ..... F04B 39/0246 417/372
5,778,838 A * 7/1998 Taue ..... F02B 33/44 123/65 VD
7,082,785 B2 * 8/2006 Nieter ..... F04B 39/066 62/505
7,131,421 B2 * 11/2006 Hada ..... F01M 11/02 123/196 R
8,635,983 B2 * 1/2014 Enokida ..... F01M 11/0004 184/104.1
2002/0159896 A1 10/2002 Finnamore et al.
2008/0011550 A1 * 1/2008 Dunn ..... F25B 43/02 184/6.23
2008/0014808 A1 * 1/2008 Hoi ..... B63B 34/10 440/111
2015/0361972 A1 * 12/2015 Barth ..... F04C 2/08 417/438
2023/0296091 A1 * 9/2023 Sekine ..... F04B 35/01 417/437

* cited by examiner

DRY-SUMP RECIPROCATING PISTON COMPRESSOR WITH LUBRICANT CIRCUIT

TECHNICAL FIELD

The present invention belongs to the technical field of reciprocating piston compressors used in the refrigeration industry and for heat pumps as well as more generally in the fields of commerce, industry, transportation, process cooling, etc. . . . .

More specifically, the present invention relates to a reciprocating compressor of the type preferably used with closed-type refrigeration circuits, of the type that draws in a refrigerant fluid in gas phase and compresses it into a refrigerant circuit in which the gas expands and then re-enters the compressor at a lower pressure.

The present invention is specially applied in the field of both transcritical carbon dioxide compressors.

PRESENT STATUS OF THE ART

In general, inside reciprocating compressors, a low-pressure portion is identified, i.e., the suction pressure of the gas inside the machine, and a high-pressure portion, i.e., the discharge pressure of the refrigerant fluid, which has been compressed by the pistons inside the cylinders.

The pistons are connected to connecting rods that are in turn driven by a crankshaft; these crank mechanisms require lubrication, and the latter is provided by feeding lubricating oil into special circuits that deliver it to various locations within the compressor.

Unlike in compressors of other types, such as screw compressors, in reciprocating compressors the lubricating oil does not contribute to the sealing between the high-pressure and low-pressure portions, which is provided by the sealing rings between the piston and cylinder.

It should be noted that in the present patent text the expression "refrigerant circuit" or "refrigeration circuit" means collectively the set of piping and equipment in which a refrigerant fluid discharged from the compressor is circulated. Hereafter this term will refer to both refrigeration circuits as such and heat pump circuits.

In so-called closed refrigerant circuit systems, the process fluid never comes into contact with the external world: the refrigerant fluid enters the compressor undergoing a rise in pressure and temperature, then is discharged from the compressor through a delivery pipe and is sent to a condenser where it releases heat to the external environment; the fluid leaving the condenser first passes through a lamination unit, then is delivered to an evaporator where it absorbs heat from the environment that is to be cooled, and finally the fluid returns to the compressor through a suction pipe.

Reciprocating compressors normally employed in systems with a closed refrigerant circuit, such as those used in refrigeration systems or heat pump systems, include a crankcase conformed in such a way as to present internally, in the low-pressure portion, a collection area in which the lubricating oil necessary for lubricating the crank mechanisms and various components within the compressor itself is accumulated. The lubricant is taken from the collection area by a pump and fed into the lubrication circuit inside the crankcase.

In systems with a closed refrigerant circuit, unlike in open-circuit systems, the lubricant is not considered a contaminant and consequently there is no need to maintain a neat physical separation between the refrigerant fluid and the lubricant, the latter, as already anticipated, is in fact stored directly inside the compressor in a specially defined collection volume in the lower part of the crankcase.

In open type compressors, driven by an external motor, the lubricant is stored in the lower part of the crankcase where the crank mechanism is housed, while in hermetic or semi-hermetic type compressors, the electric motor is also housed inside the crankcase and the lubricant is collected below the crank mechanism and rotor of the motor. A pump ensures the circulation of lubricant from the collection area to the bushings and other mechanical parts of the compressor where necessary. Progressively, the lubricant applied to the various mechanical components falls back into the crankcase, either by the effect of gravity or due to the reciprocal movement of the components themselves.

The contiguity between the refrigerant fluid and the lubricant, however, results in an undesirable dragging effect of the lubricant by the fluid as it passes within the crankcase from the low-pressure portion to the high-pressure portion: part of the lubricant, mixing with the refrigerant fluid, is then progressively carried into the refrigeration circuit where it is deposited on the walls of the heat exchangers and/or in the piping, causing the system performance to decay, as well as a gradual reduction of the lubricant stored within the crankcase The mixing between the lubricant and the refrigerant fluid is also facilitated by the fact that the lubricant used in the compressor must necessarily be at least partially miscible with the refrigerant fluid since otherwise there would be a risk of possible freezing of the lubricant as it passes through the portion of the circuit that is at a lower temperature.

Compressors commonly employed in refrigeration or heat pump systems are very compact machines, in fact, in such sectors, there is a great need to keep the crankcase size and weight as small as possible, also in order to reduce production costs. With the minimization of the crankcase size, however, there is also a consequent reduction in the internal volume allocated to the collection of lubricant, so that the lubricant free surface lies just below the crank mechanism or even comes to submerge the lower part of the rotor of the motor, as is particularly the case in semi-hermetic compressors.

The close proximity between the lubricant free surface and the moving mechanical components increases the undesirable dragging effect of the lubricant by the refrigerant fluid. Such dragging is all the greater as the displacement and rotational speed of the compressor increase.

The lubricant dragged by the refrigerant fluid partially re-enters the compressor after passing through the refrigerant circuit however, a certain amount of lubricant is dispersed in the circuit outside the compressor itself and this amount is the greater the more extensive and complex the refrigerant circuit is. Excessive reduction in the level of lubricant present in the crankcase can cause the compressor to suddenly stall and/or cause excessive wear of mechanical parts, particularly when there is insufficient residual lubricant to ensure continuous lubrication and/or a lubricating film of sufficient thickness.

Another disadvantage of compressors of the type described here is related to excessive heating of the lubricant collected inside the crankcase due to heat transfer by the compressor delivery pipes. As the temperature increases, the viscosity of the lubricant decreases significantly with a consequent decay in lubricating properties.

These problems are particularly felt in semi-hermetic compressors with integrated motors that use CO2 as the process fluid, the latter in fact reaches very high temperatures in the compression phase and some of this heat is transferred to the compressor crankcase and then to the lubricant contained in it.

To remedy, at least in part, these problems, oil separator devices have been developed that are used to recover a portion of the lubricant dragged away from the compressed fluid. Such devices are normally placed immediately at the inlet of the refrigerant circuit, downstream of the compressor, and are capable of separating a portion of the lubricant that has mixed with the fluid, for example through one or more filters, by returning it to the compressor crankcase.

However, not all systems include an oil separator; moreover, no oil separator currently in existence is capable of fully recuperating the lubricant that is discharged from the compressor, and as a result, it is not possible to prevent the gradual dispersion of the lubricant into the refrigerant circuit.

Another unresolved issue in systems of the aforementioned type is that such oil separators must necessarily be installed on the hottest portion of the refrigerant circuit, i.e., at the inlet of the refrigerant circuit, immediately downstream of the cock separating the compressor from the circuit, and this is primarily for the purpose of intercepting the lubricant mixed into the fluid before it enters the refrigerant circuit. However, the compressed fluid exiting the compressor is very hot, and consequently the lubricant that is recovered from the separator and returned to the crankcase is also at a very high temperature. This has very negative effects on compressor functionality and component longevity due to the low viscosity of the hot lubricant.

U.S. Pat. No. 5,277,564 describes a hermetic screw compressor coupled to an external oil separator, the latter is conformed as a tank equipped with a filter to intercept the lubricating oil carried by the fluid exiting the compressor. The compressed and very hot fluid leaving the compressor is delivered to the separator, where the oil mixed with the fluid is intercepted by the filter and returned to the compressor crankcase for lubrication. The oil recovered from the separator is at a high temperature and therefore has poor lubricating properties and poor adhesion on the components to which it is applied.

In systems of the known type, in which the oil separator is located on the delivery manifold of the compressor, one or more additional devices, such as valves or other pressure control devices, are also required to allow the return of the oil collected in the separator back to the compressor crankcase, while maintaining the pressure differential present between the separator itself, which is at delivery pressure, and the circuit returning the oil to the crankcase, at suction pressure. This solution thus results in an increase in the number of components required and in plant complexity in general, leading to higher implementation and maintenance costs, as well as lower reliability of the entire system.

OBJECTS AND SUMMARY OF THE INVENTION

The problem of having a dry-sump reciprocating compressor for closed refrigerant circuits, in which the effect of lubricant dragging by the refrigerant is minimal or more preferably zero, is therefore felt.

A further purpose of the present invention is to provide an extremely compact reciprocating piston compressor in which the lubricant collection volume is sufficiently distant from the portions of the compressor at higher temperature and pressure, thereby avoiding undesirable heating of the lubricant, without the need to install auxiliary lubricant cooling systems.

Another purpose of the present invention is to provide a reciprocating compressor in which the lubricant free surface is sufficiently far from the moving parts of the compressor so as to prevent the lubricant dragging effect due to contact and/or proximity with moving mechanical components and crank mechanisms.

Solutions are known in which the lubricant collection area is located in the lower portion of the crankcase, as for example is shown in EP4187090 and U.S. Pat. No. 5,591,011, however, in this type of configuration the free oil surface remains in contact with the gases that are in the compressor crankcase and the risk of them being dragged by the lubricant is high.

Not the least purpose of the present invention is to provide a compressor of the aforesaid type in which the low-pressure portion of the crankcase, where the connecting rods and crankshaft are housed, can be inspected without necessarily having to shut down the compressor and stop the system.

Finally, a purpose of the present invention is to provide a reciprocating piston compressor for refrigerant circuits and/or heat pumps with a crankcase that is very small in weight and size compared with conventional type compressors, not requiring additional internal volume to store the lubricant.

These and other purposes, which will become clear to the skilled person in the field from reading this text, are achieved by means of a dry-sump reciprocating compressor comprising a lubricant distribution circuit that includes an external lubricant collection reservoir below the compressor crankcase and communicating with the latter by means of drainage holes defined in the outer wall of the crankcase.

In the present patent text, the term "dry sump" refers to a crankcase that may or may not have an internal lubricant collection area in its lower portion, the latter, however, is not used to store the lubricant since the lubricant is collected in a separate reservoir and from that reservoir, by means of a pump, is fed into the interior of the compressor to lubricate the various mechanical parts and components, e.g., main bushings and connecting rods.

The same inventive concept is applicable both to reciprocating compressors with motors outside the crankcase, also known as open compressors, and to reciprocating compressors with motors integrated inside the crankcase, known as semi-hermetic or hermetic compressors.

Advantageously, the compressor object of the present invention includes a crankcase in the lower portion of which, at low pressure, are defined one or more drain holes communicating with an underlying reservoir, separate from the compressor. The lubricant applied to the mechanical components within the crankcase falls by gravity to the bottom of the crankcase and then drains into the reservoir below through said one or more drain holes. Any lubricant mixed with the refrigerant fluid, once it re-enters the low-pressure portion of the crankcase, also separates by gravity from the fluid and drains through the drain holes into the reservoir below Very advantageously, the solution that is the subject of this patent application makes it possible to minimize the dimensions and weight of the compressor crankcase by storing the lubricant in the reservoir underlying it, under conditions of low pressure and low temperature, substantially corresponding to the conditions of the low-pressure portion of the crankcase.

Preferably, but not exclusively, the lubrication circuit pump is a mechanical gear pump of the self-priming type and is connected integrally to the crankshaft of the compressor. The pump draws lubricant stored in the reservoir below the compressor and delivers it to a plurality of lubricant distribution conduits preferably formed at least partially inside the crankshaft, thereby ensuring a continuous flow of lubricant to the bushings and other compressor components that need to be lubricated.

The inlet of the oil suction conduit is located in the lower portion of the reservoir in order to avoid sucking in the vapor phase as well.

During compressor operation, the oil level can vary significantly, so to avoid the possibility of sucking in vapor even in the case where the oil level in the reservoir is particularly low, the object of the invention includes a subdivision internal to the reservoir, configured to create, in the portion of the reservoir surrounding the inlet of the suction conduit, an suction chamber that is placed in communication with the remaining portion of the reservoir only through a small passageway located near, or adjacent to, the bottom wall of the reservoir. Thanks to this configuration, only oil in the liquid phase can enter the suction chamber According to a particularly complete embodiment, the compressor crankcase includes one or more openings defined in the outer wall of the low-pressure portion, said openings being normally closed by respective doors preferably connected to the crankcase in an airtight manner by means of screws or bolts. Said doors can be removed to inspect the interior of the crankcase after the compressor has stopped and without first having to extract the lubricant stored in the reservoir In some embodiments, the lubricant distribution circuit advantageously includes an overpressure valve that opens when a predetermined value of lubricant pressure is exceeded, diverting the flow out of the lubrication circuit and directly into the crankcase so that the lubricant can return through drain holes into the reservoir below.

DETAILED DESCRIPTION OF AN EMBODIMENT OF THE INVENTION

Figure 1:
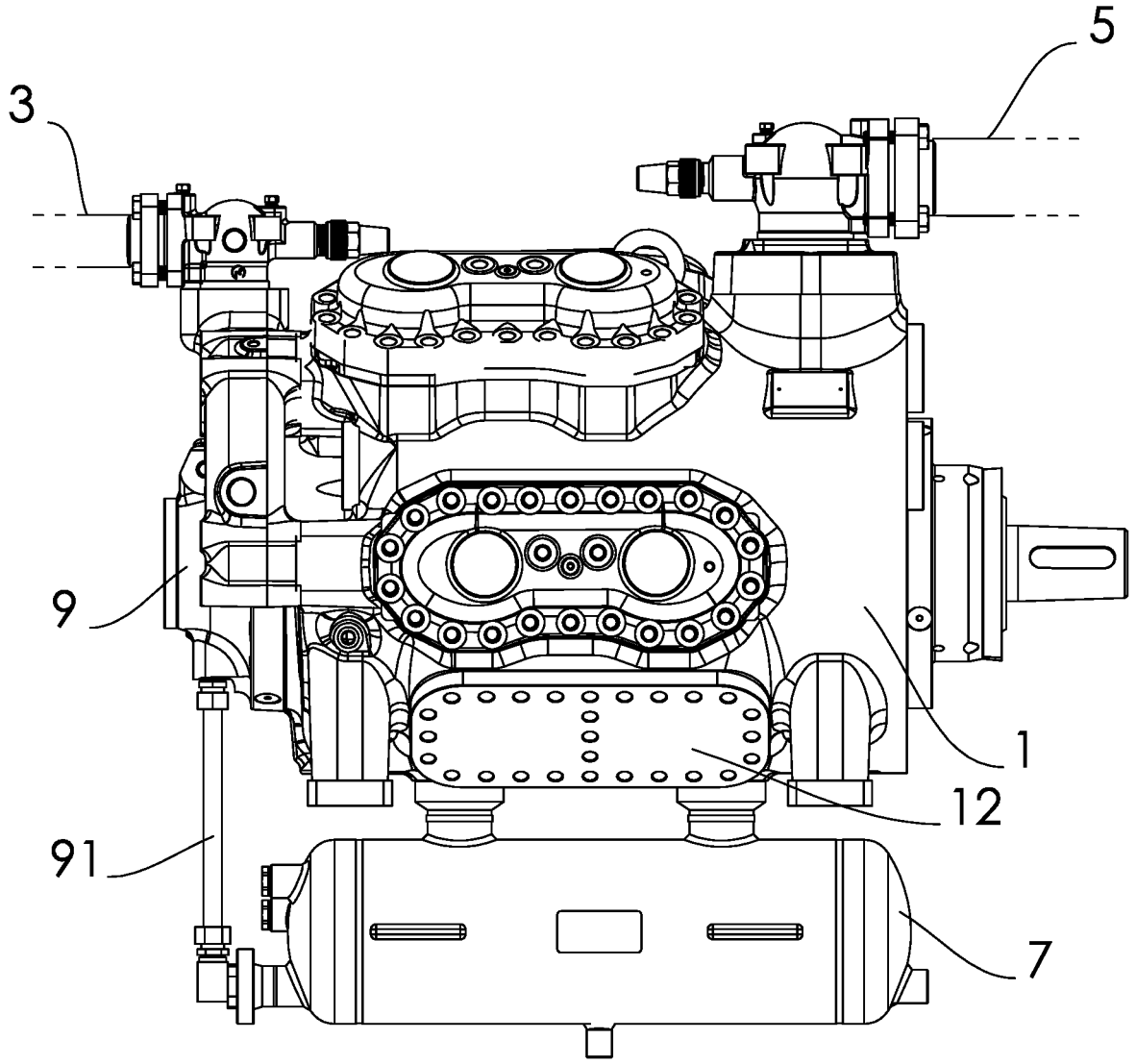
FIG. 1 shows a lateral view of an embodiment of the dry-sump compressor with external oil reservoir.
Figure 2:
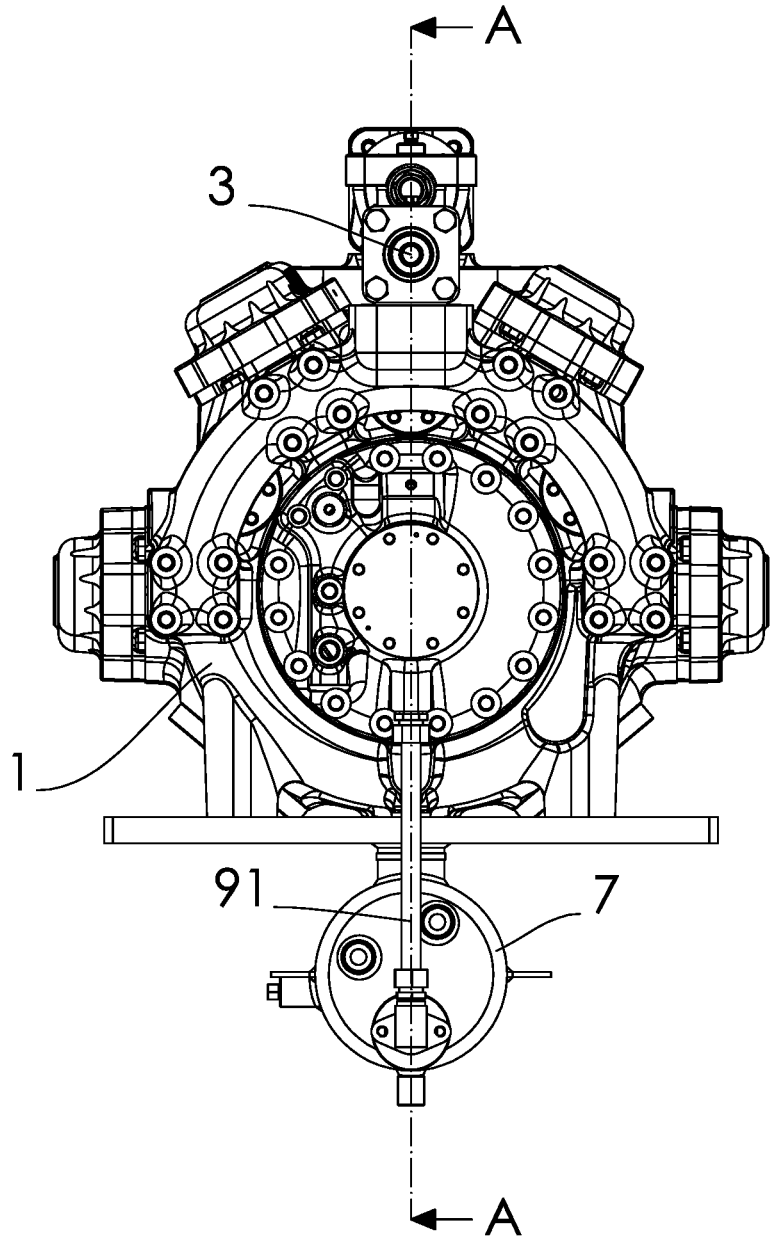
FIG. 2 shows a front view of the compressor.
Figure 3:
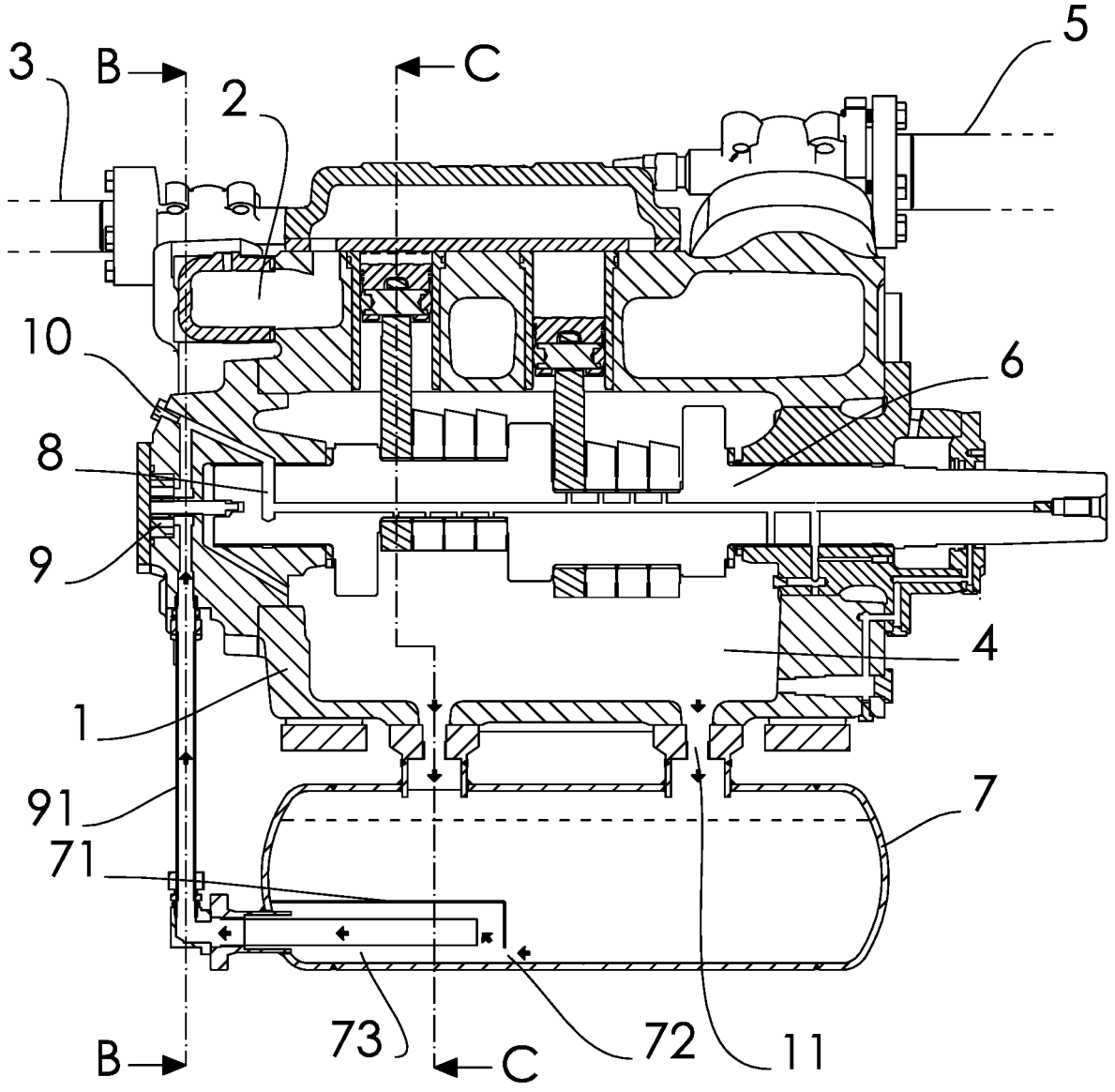
FIG. 3 shows the longitudinal section A-A of the compressor, the baffle plate (71), the suction chamber (73) and the passage (72) defined in the lower portion of the baffle plate (71) can be seen in section; the lubricant flow is indicated with arrows.
Figure 4:
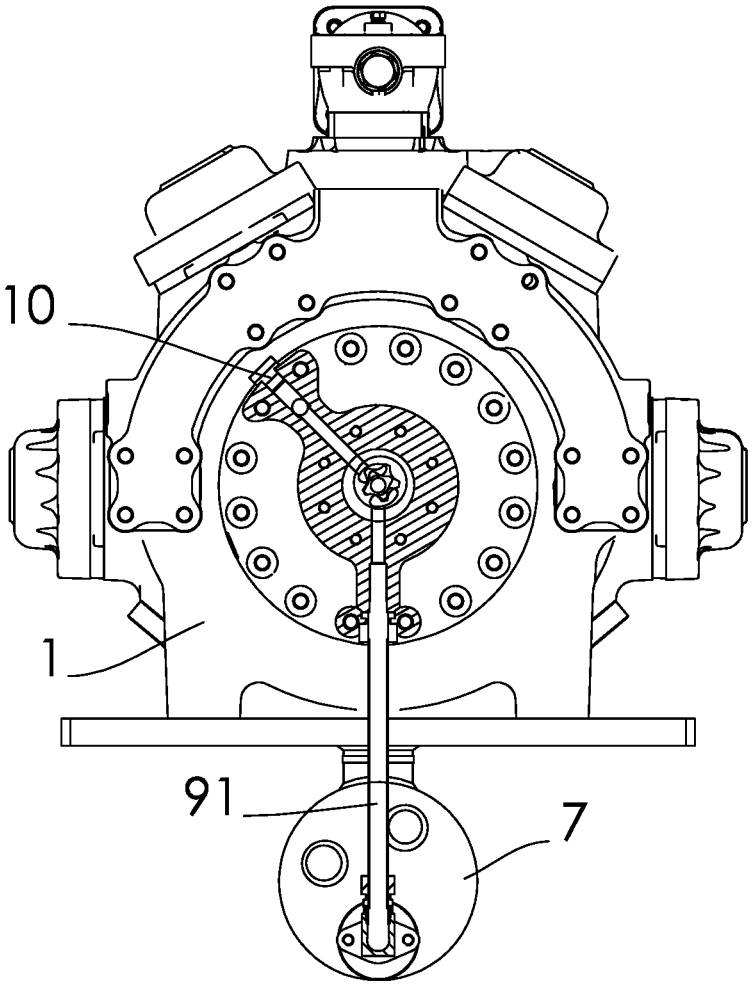
FIG. 4 shows the B-B cross section of the compressor.
Figure 5:
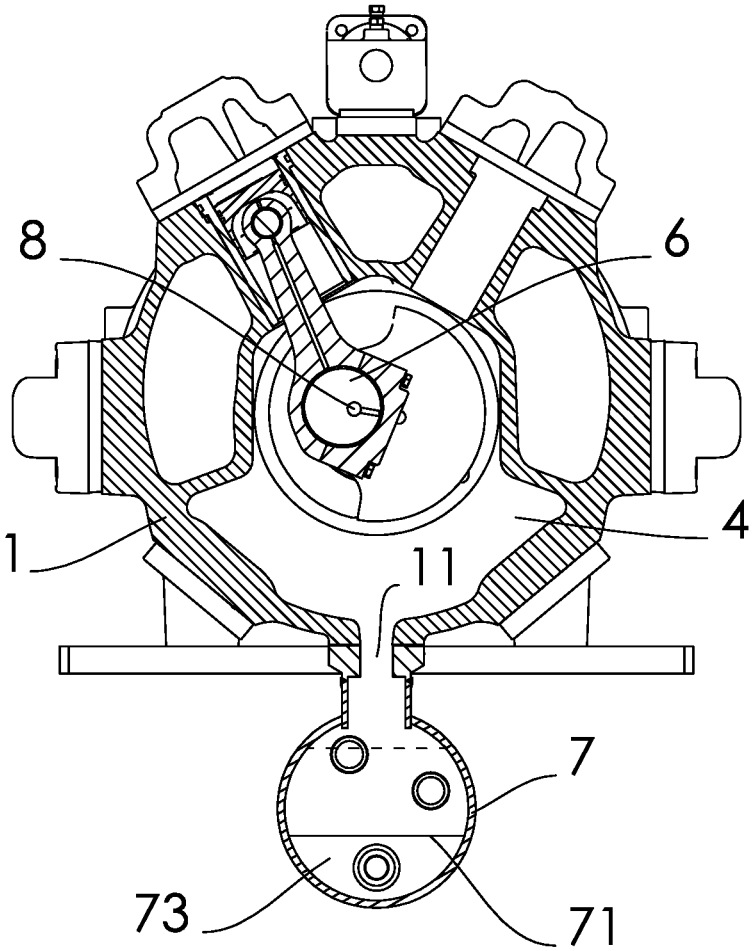
FIG. 5 shows the C-C cross section of the compressor.

The embodiment shown in FIG. 1 of the dry-sump open-type reciprocating piston compressor that is the subject of this patent application comprises a crankcase (1) in which a low-pressure portion (4), to which the suction pipe (5) is connected, and a high-pressure portion (2) connected to the delivery pipe (3) by means of which the refrigerant fluid compressed by the pistons is sent toward a refrigerant circuit are defined. The low-pressure portion (4) of the crankcase (1) houses the motor and crank mechanisms, in particular the crankshaft (6) to which the piston connecting rods are attached.

Defined in the lower wall of the crankcase (1) are two drain holes (11) that connect the low-pressure portion (4) of the crankcase (1) with an underlying reservoir (7) for collecting lubricant, which is separate and external to the crankcase (1) of the compressor. Within said reservoir (7) is stored the lubricant required to lubricate the various mechanical components of the compressor, such as the connecting rod bushings and crankshaft bushings (6). The lubricant is taken from the reservoir (7) by means of a positive displacement pump (9) that feeds it to the conduits (8) of the lubricant distribution system inside the crankcase (1).

The lubricant that drips from the lubricated components and/or separates from the refrigerant fluid upon re-entry into the intake chamber, falls onto the inner walls of the low-pressure portion (4) of the crankcase (1) and through said drain holes (11) is transferred by gravity into the underlying reservoir (7). The inner walls of the crankcase (1) are suitably shaped to facilitate the transfer of lubricant to the underlying reservoir (7). The crankcase (1) is connected to the underlying reservoir (7) by flanged couplings.

In the preferred embodiment described here and shown in the attached figures, said positive displacement pump (9) is a gear type pump and is driven directly by said crankshaft (6), being coaxial to it. The pump (9) draws the lubricant from the reservoir (7) through a suction manifold (91) and feeds it inside the conduits (8) formed in the hub of the pump (9), the latter being integrally connected to the walls of the crankcase (1), and inside the crankshaft (6).

In the attached figures, an embodiment of the compressor is shown that includes a reservoir (7) of elongated shape arranged with its longitudinal axis parallel to the longitudinal axis of the compressor; other embodiments with reservoirs of different conformation are, of course, possible.

Inside the reservoir (7) for collecting the lubricant there is a compartment that delimits a suction chamber (73) that is separated from the remaining part of said reservoir (7) by means of a baffle plate (71) in which a small passage (72) located near, or adjacent to, the bottom wall of the reservoir is defined through which the lubricant passes inside the suction chamber (73), in this way the compressor always sucks oil in the liquid phase and does not suck gas.

In a particularly complete embodiment said reservoir (7) includes an external surface at least partially finned or a different cooling system. This solution allows very advantageously to reduce the temperature of the lubricant stored inside the reservoir (7), without changing the temperature of the refrigerant fluid that flows inside the crankcase (1).

The lubricant distribution circuit also includes a safety by-pass valve (10) whose function is to keep the pressure within said circuit below a preset maximum threshold. In the embodiment shown in the attached figures, this valve (10) is located in the conduit (8) upstream of the section formed inside the crankshaft (6). When the lubricant pressure exceeds the preset maximum threshold, valve (10) intervenes by opening a discharge pipe that releases the lubricant outside the lubrication circuit, directly into the crankcase (1); said valve (10) automatically closes again once the lubricant pressure has returned to the optimum range. One possible embodiment of the bypass valve (10) comprises a shutter that is kept closed by means of a spring or other similar elastic counteracting means and that opens, causing the lubricant to flow through the discharge channel, when the thrust exerted by the lubricant on the shutter exceeds the counteracting action of the spring. Depending on the possible embodiments of the compressor, such a valve (10) may be located at other positions in the lubrication circuit.

Four openings, two on each side of the crankcase (1), are defined in the low-pressure portion (4) of the crankcase (1) for inspection and maintenance of components integrated within the compressor. Normally, these openings are closed by respective doors (12) that are attached to the crankcase (1) in an airtight manner by means of screws or bolts. In the technical solution that is the subject of this patent application, there is no accumulation of lubricant in the low-pressure portion (4) of the crankcase (1), which makes it possible to open the aforementioned doors (12) without first removing the lubricant from the compressor.

The invention claimed is:

1. A dry-sump reciprocating piston compressor for closed refrigerant circuits, comprising: a crankcase-within which is defined a high-pressure portion communicating with a delivery pipe and a low-pressure portion communicating with a suction pipe, a crankshaft which by means of respective connecting rods drives one or more pistons sliding within corresponding cylinders, and a lubricant distribution circuit within said crankcase, wherein said lubricant distribution circuit comprises:

a lubricant collection reservoir underlying said crankcase and communicating with it through one or more drain holes defined in the outer wall of the lower portion of said crankcase;

one or more conduits internal to said crankcase into which the lubricant flows to be delivered to one or more points within said crankcase;

a positive displacement pump that draws the lubricant from said reservoir through a suction line and feeds it to said one or more conduits;

and wherein within said lubricant collection reservoir there is a compartment that delimits a suction chamber, the latter being separated from the remaining part of said reservoir by means of a baffle plate in which a small passage is defined for the transfer of lubricant into said suction chamber, wherein said one or more drain holes are bordered by respective flanges protruding from said crankcase for coupling by means of screws or bolts with corresponding flanges protruding superiorly from said tank.

2. Reciprocating compressor of claim 1, wherein said passage is defined in said baffle plate near, or adjacent to, the bottom wall of the reservoir by means of which the lubricant passes into said suction chamber.

3. Reciprocating compressor according to claim 2, wherein said lubricant distribution circuit includes an overpressure by-pass valve suitable for discharging the lubricant outside said circuit and directly inside the crankcase when the lubricant pressure reaches a certain predetermined threshold value.

4. Reciprocating compressor according to claim 1, wherein said low-pressure portion of said crankcase is internally conformed so as to induce gravity transfer of lubricant from the crankcase to the underlying reservoir through said one or more drain holes.

5. Reciprocating compressor according to claim 1, wherein said positive displacement pump is coaxial to said crankshaft of said compressor.

6. Reciprocating compressor according to claim 1, wherein said one or more conduits are defined at least in part within the crankshaft of said compressor.

7. Reciprocating compressor according to claim 1, wherein said one or more conduits are defined at least partially within the hub of said positive displacement pump.

8. Reciprocating compressor according to claim 1, wherein said reservoir comprises cooling means for reducing the temperature of the lubricant.

9. Reciprocating compressor according to claim 8, wherein said cooling means comprises an outer surface of said reservoir at least partially finned.

10. Reciprocating compressor according to claim 1, wherein said crankcase includes one or more inspection openings defined in the outer wall of said low pressure portion.

11. Reciprocating compressor according to claim 2, wherein said low-pressure portion of said crankcase is internally conformed so as to induce gravity transfer of lubricant from the crankcase to the underlying reservoir through said one or more drain holes.

12. Reciprocating compressor according to claim 3, wherein said low-pressure portion of said crankcase is internally conformed so as to induce gravity transfer of lubricant from the crankcase to the underlying reservoir through said one or more drain holes.

13. Reciprocating compressor according to claim 2, wherein said positive displacement pump is coaxial to said crankshaft of said compressor.

14. Reciprocating compressor according to claim 3, wherein said positive displacement pump is coaxial to said crankshaft of said compressor.

15. Reciprocating compressor according to claim 4, wherein said positive displacement pump is coaxial to said crankshaft of said compressor.

16. Reciprocating compressor according to claim 2, wherein said one or more conduits are defined at least in part within the crankshaft (6) of said compressor.

17. Reciprocating compressor according to claim 3, wherein said one or more conduits are defined at least in part within the crankshaft (6) of said compressor.

18. Reciprocating compressor according to claim 4, wherein said one or more conduits are defined at least in part within the crankshaft (6) of said compressor.

19. Reciprocating compressor according to claim 2, wherein said one or more conduits are defined at least partially within the hub of said positive displacement pump.

* * * * *